US005638550A

United States Patent [19]

Hube

[11] Patent Number: 5,638,550

[45] Date of Patent: Jun. 17, 1997

[54] INTEGRAL, EXPANDABLE, INFLATABLE, ADJUSTABLE BELT

[76] Inventor: Paul Hube, 502 Burlington Ct., Edgewood, Md. 21040

[21] Appl. No.: 543,376

[22] Filed: Oct. 16, 1995

[51] Int. Cl.[6] ..... A41F 3/02; A41F 9/00

[52] U.S. Cl. ..... 2/311; 2/338; 2/920; 2/DIG. 3

[58] Field of Search ..... 2/2, 338, DIG. 3, 2/311, 312, 323, 329, 302, 912, 919, 920, 308, 309, 321; 128/876, 875, 869; 602/13, 19

[56] References Cited

U.S. PATENT DOCUMENTS 1,225,843 5/1917 Minnich et al. ..... 2/302
4,030,646 6/1977 Switak et al. ..... 2/69.5
4,737,994 4/1988 Galton ..... 2/2
5,195,948 3/1993 Hill et al. ..... 128/876
5,325,539 7/1994 Kronenberger ..... 2/195.2
5,450,858 9/1995 Zablotsky et al. ..... 2/338

*Primary Examiner*—C. D. Crowder
*Assistant Examiner*—Larry D. Worrell, Jr.
*Attorney, Agent, or Firm*—Walter G. Finch

[57] ABSTRACT

The present invention is directed to a garment support that satisfies this need for substantial waist size adjustability, yet maintaining comfort and style. A garment support having features of the present invention comprises a flexible, expandable, inner tube-type device to which an air intake and release mechanism will be attached. The present invention can be built into the inner waistband of garments or can be made detachable therefrom.

2 Claims, 1 Drawing Sheet

INTEGRAL, EXPANDABLE, INFLATABLE, ADJUSTABLE BELT

BACKGROUND OF THE INVENTION

This application is an improvement on the current garment supports located on the inner waistband of pants, shorts, skirts, trousers and the like. The purpose for such supports is to hold up the garments without the necessity of an external belt.

Because clothing is sized for an "average" person, many people have difficulty finding a garment that will fit the proportions of their body. Something which fits a person's hips or thighs may be too large for their waist. Clothing manufacturers lose countless sales due to this very problem. It may be necessary to buy numerous belts to coordinate with the many different garment fabrics and patterns. Some garment bottoms do not even come with belt loops so they may need to be altered at an additional expense.

Depending on, among other things, the thickness of the garment fabric and the fluctuations in a person's weight, a belt which fits one day may not fit on the same or another garment the next day. Furthermore, if the waist of a garment is a lot larger than the person's waistline, the use of an external belt will cause uncomfortable and unsightly bulges of fabric beneath the belt which in turn tends to push the belt upwards in the spaces between the belt loops.

The current garment supports which attach to the inside waistband do solve some of the above-mentioned problems in that they may eliminate the need for external belt loops and a multiplicity of belts since they are out of site. However, these current garment supports consist of one or more elastic strips somehow attached to the inner waistband. The problem with elastic strips is that they are of limited stretchability. Beyond a certain point, usually less than one half their resting circumference, they become uncomfortably tight, constricting, and may possibly break. Thus, there may still be a need to buy a number of different lengths of this elastic material to fit all of a person's garments. Furthermore, this type of garment support does not eliminate the fabric bulges around the waistband.

For the foregoing reasons, there is a need for a single garment support which will accommodate substantial fluctuations in waist size while remaining comfortable and look good.

SUMMARY OF THE INVENTION

The present invention is directed to a garment support that satisfies this need for substantial waist size adjustability, yet maintaining comfort and style. A garment support having features of the present invention comprises a flexible, expandable, inner tube-type device to which an air intake and release mechanism will be attached. The present invention can be built into the inner waistband of garments or can be made detachable therefrom.

OBJECTS OF THE INVENTION

Therefore, it is an object of this invention to provide for a garment support which can be adjusted to fit a wide range of waist sizes, even when there are fluctuations in the user's weight.

It is another object of this invention to provide for a comfortable garment support that does not become too loose or restricted depending on garment to which it is attached.

It is a further object of this invention to provide for a comfortable fit while maintaining the smooth appearance of the garment such that no bulges in fabric appear due to the support.

It is yet a further object of this invention to provide for a single support which will coordinate with the garment regardless of its type of fabric, pattern, or size.

It is still a further object of this invention to provide a means for either permanent or removable attachment.

BRIEF DESCRIPTION OF THE INVENTION

These and other intended objects, features, and advantages of the invention will become more readily apparent form the following with reference to the accompanying drawings in which.

DETAILED DESCRIPTION OF THE INVENTION

The present invention relates to a garment support which may be permanently attached to the inner waistband of a garment or be removable therefrom. The inner tube-like body will be made of rubber, plastic, or any other suitable material which allows for flexibility, elasticity, and expandability. Attached to the this inner tube-like body will be a small button to pump air into the tube and a release valve to let the air out of the tube.

Figure 1:
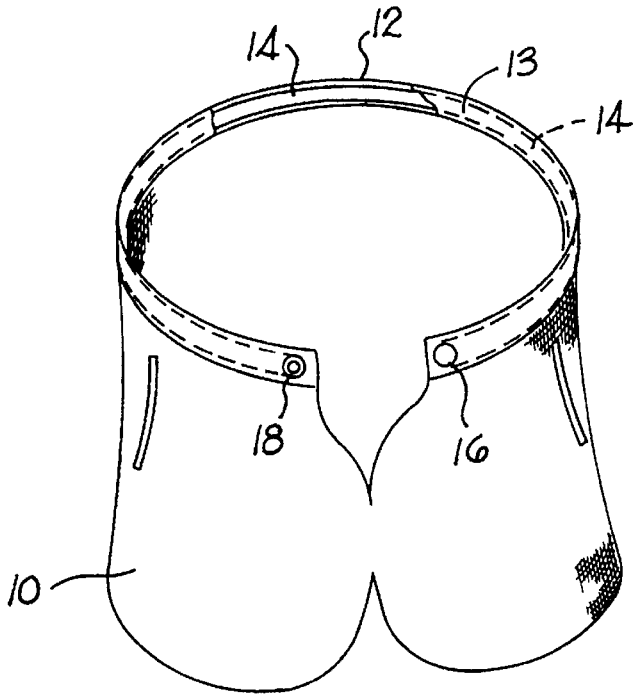
FIG. 1 is a perspective view of one embodiment of the invention located within the inner lining of the waistband of a garment.
Figure 2:
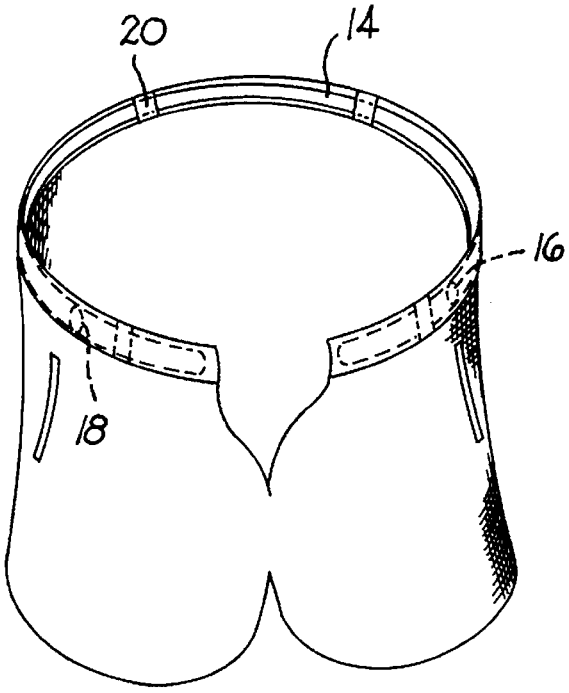
FIG. 2 is a perspective view of a second embodiment of the invention attached to the inner waistband of a garment by belt loops.
Figure 3:
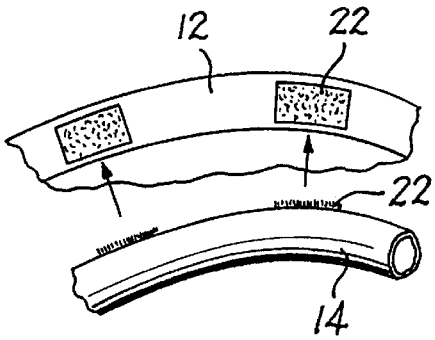
FIG. 3 is a close-up view of a third embodiment of the invention being attached to the inner waistband of a garment by strips of velcro.

Referring now to FIGS. 1 and 2, the inflatable, flexible belt 14 is shown attached to the inner waistband 12 of the garment 10. The belt 14 can be attached to the inner waistband 12 either by being sewn into the inner lining 13 of the garment 10 as shown in FIG. 1, or by belt loops 20 as shown in FIG. 2. The belt 14 may also be attached to the inner waistband 12 by using a hooks and loops mechanism 22, such as velcro strips, as shown in FIG. 3.

The invention may be permanently attached to the garment such that the invention is located within the inner lining of the waistband. The air intake and release mechanisms may be positioned through the material of the garment such that the wearer can have access from outside the garment.

If as shown in FIG. 1 the belt 14 is attached to the garment 10 by the inner lining 13, the air intake button 18 can be attached to one end of the belt 14 and extend through the waistband 12 to be accessible from outside the garment 10. The air release valve 16 is then attached to the far end of the belt 14 and likewise protrudes from the waistband 12 of the garment 10 to accessible from outside the garment.

Clothing manufacturers may have the option of attaching the present invention to their garments upon production to insure that their product will fit the not-so-average person's proportions. Depending on the means of attachment, the manufacturer could make the product either permanently attached or removable.

If it is desired to make the invention removable from the garment, the air pump and release valve can be located anywhere on the side of the tube facing the garment. Thus, the slightly raised surface of either pump or valve will not be touching the wearer. The wearer need only reach slightly into his waistband to adjust the amount of air in the tube. The whole apparatus may be attached to the inner waistband of a garment by a variety of means, such sewn in belt loops, or a self adhesive hooks and loops mechanism of which velcro strips is an example.

If the belt 14 is attached by belt loops 20 as shown in FIG. 2, a hooks and loops mechanism 22 as shown in FIG. 3, or any other means of attachment, the air intake button 18 and release valve 20 do not protrude through the waistband 12. As shown in FIG. 2, the air intake button 18 is attached to the surface of belt 14 which faces the inner waistband 12 of garment 10 such that it does not touch the wearer's body. The release valve 16 is likewise attached to the same inward surface of belt 14 as shown in FIG. 2. The air intake button 18 and release valve 16 are located at the front of the wearer's body where the stomach is so that they can be easily accessible.

The placements of the air intake button and release valve disclosed above are the suggested placement, however, the intake and release buttons could be placed anywhere along the length of the belt. They could even be placed side by side, on the inside or outside of the belt.

With the air pump and release valve, a person can adjust the amount of air inside the tube to fit their waist size. The more air that is pumped into the tube, the tighter the garment becomes, while the less air in the tube, the looser the garment becomes.

The present invention eliminates the frustration of having to forego the otherwise perfect pair of pants, shorts, skirt, etc. because of the waist size. The present invention also reduces the need for multiple external belts, costly alterations, external belt loops, and eliminates uncomfortable and unsightly bulges of fabric.

It is understood that the above description is illustrative only, small variations in the structure components could be made without departing from the intended scope of the claim.

What is claimed is:

1. A garment support, comprising:

an inflatable belt;

an air intake mechanism connected to said inflatable belt providing for inflation of said belt;

an air release mechanism connected to said inflatable belt providing for deflation of said belt;

belt loops sewn into an inner waistband of a garment for removably attaching said inflatable belt to said inner waistband; and wherein said air intake and release mechanisms are connected to an outer surface of said inflatable belt such that said mechanisms do not contact the body yet remain easily accessible.

2. A garment support, comprising:

an inflatable belt;

an air intake mechanism connected to said inflatable belt providing for inflation of said belt;

an air release mechanism connected to said inflatable belt providing for deflation of said belt;

a plurality of inter-engaging strips for removably attaching said inflatable belt to an inner waistband of a garment such that some of said strips are attached to said inflatable belt and other of said strips are attached to said inner waistband; and wherein said air intake and release mechanisms are connected to an outer surface of said inflatable belt such that said mechanisms do not contact the body yet remain easily accessible.

* * * * *